US005928096A

United States Patent [19]

Boardman et al.

[11] Patent Number: 5,928,096

[45] **Date of Patent: *Jul. 27, 1999**

[54] GROUND EFFECT HOCKEY PUCK

[76] Inventors: Craig W. Boardman, 27 Glorieta East, Irvine, Calif. 92620; Warren P. Boardman, 25301 De Salle St., Laguna Hills, Calif. 92653

[ * ] Notice: This patent issued on a continued prosecution application filed under 37 CFR 1.53(d), and is subject to the twenty year patent term provisions of 35 U.S.C. 154(a)(2).

[21] Appl. No.: 08/786,926

[22] Filed: Jan. 23, 1997

[51] Int. Cl.[6] ..... A63B 71/00

[52] U.S. Cl. ..... 473/588

[58] Field of Search ..... 473/588, 587

[56] References Cited

U.S. PATENT DOCUMENTS

| | | | |
|---|---|---|---|
| 2,494,929 | 1/1950 | Colaluca | 473/588 |
| 3,726,526 | 4/1973 | Radovich | 473/588 |
| 3,784,204 | 1/1974 | Felber | 473/588 |
| 4,151,997 | 5/1979 | Glovak et al. | 473/588 |
| 4,370,824 | 2/1983 | Resnicow | 473/588 X |
| 5,014,990 | 5/1991 | Kaser et al. | 473/588 |
| 5,269,520 | 12/1993 | Vellines | 473/588 |
| 5,275,410 | 1/1994 | Bellehumeur et al. | 473/588 |
| 5,482,274 | 1/1996 | Bellehumeur | 473/588 |
| 5,518,238 | 5/1996 | Hu et al. | 473/588 X |
| 5,697,858 | 12/1997 | Lekavich | 473/588 |
| 5,707,308 | 1/1998 | Liu | 473/588 |

*Primary Examiner*—Raleigh W. Chiu

[57] ABSTRACT

A ground effect hockey puck 11 for playing on surfaces other than ice, wherein the unique aerodynamic design allows the ground effect hockey puck 11 to float on a cushion of air with minimal friction with the playing surface, approximating the physical performance characteristics of the traditional hard rubber puck used on ice surfaces while maintaining both speed and accuracy. A unique roller 44 mechanism to minimize friction during the transition period upon first being struck by the stick and the period after the hockey puck drops below the speed at which the air cushion can fully support its weight. An interchangeable internal body alignment and weight adjustment ring 32 to allow variation of the basic puck's flight characteristics and weight, and a simplified mechanical design to allow ease of repairs and modification to particular circumstances and performance desired.

4 Claims, 1 Drawing Sheet

GROUND EFFECT HOCKEY PUCK

BACKGROUND

1. Field of Invention

This invention relates to a hockey puck with aerodynamic advantages to allow it to float on a cushion of air with minimal friction with the playing surface.

The field of invention is sporting goods and the invention relates particularly to pucks of the type that are used on a surface other than ice.

2. Description of Prior Art

The game of roller hockey is played on a playing surface other than ice. Although Ice hockey has been a popular sport, it has been limited to the colder winter climates or played on a artificial ice surface on an indoor rink. In-line roller skates have made it possible to duplicate the game of ice hockey on non-ice surfaces. The hard rubber pucks used in ice hockey would not slide on a non-ice surface satisfactorily. Several puck designs have tried to replicate the motion of an ice hockey puck on non-ice surfaces. These designs of pucks for non-ice surfaces are shown in U.S. Pat. Nos. 5,275,410; 4,111,419; 3,997,164; 4,801,144; 3,726,526; 3,784,204; and 2,727,744. Several of these designs have runner type devices which are rotatable such as a ball bearing intended to reduce friction or have protruding pegs to raise the body of the puck from the playing surface to reduce the coefficient of friction by minimizing the contact area. It has been found that this type of puck does not satisfactorily exhibit the performance characteristics of an ice hockey puck on an ice surface.

OBJECTS AND ADVANTAGES

Few hockey pucks have been designed with aerodynamic advantages. Prior art has developed several hockey pucks for playing on non ice surfaces. Several of these pucks have tried to replicate the motion of an ice hockey puck on non-ice surfaces. These designs use a system of runners type devices, protruding pegs or large rollers which are intended to reduce the coefficient of friction. It has been found that this type of puck does not satisfactorily exhibit the performance characteristics of an ice hockey puck on an ice surface.

The unique aerodynamic design and roller mechanism of the ground effect hockey puck allows it to float on a cushion of air with minimal friction with the playing surface, thereby approximating the physical performance characteristics of the traditional hard rubber puck used on ice surfaces. The ground effect hockey puck provides a simplified mechanical design to allow ease of repairs and modifications to particular circumstances and performance desired by interchangeable internal body alignment and weight adjustments rings.

DRAWING FIGURES

FIG. 1 shows the various aspects of the ground effect hockey puck 11.

REFERENCE NUMERALS USED IN THE DRAWINGS

11—Ground Effect Hockey Puck
14—Puck Body Half
17—Body Threaded Recess
20—Body Assembly Threaded Nipple
23—Body Assembly Lock Recess
26—Body Assembly Lock Pin
29—Body Alignment Ring Recess

32—Body Alignment and Weight Adjustment Ring
35—Body Bumper Recess
38—Body Bumper Holding Edge
42—Puck Body Retaining Pocket
41—Perimeter Resilient Bumper
44—Roller
45—Roller Retainer Insert
47—Roller Retainer Pocket
50—Roller Retainer Lip
53—Roller Spacer Pin
56—Roller Spacer Ring
62—Turbulator Groove
65—Secondary Turbulator Groove
68—Pressure Balance Groove

SUMMARY OF THE INVENTION

A few hockey pucks are designed to have some aerodynamic advantages, although, this has not been common place in practice. The hockey puck invention, hereinafter described, is an original and unique ground effect hockey puck, in that it features an aerodynamic design to allow it to float on a cushion of air with minimal friction with the playing surface; an original and unique roller mechanism to minimize friction during the transition period upon first being struck by the stick and the period after the hockey puck drops below the speed at which the air cushion can fully support its weight; an interchangeable internal ring; and external bumper to allow variation of the basic pucks resilience; and a simplified mechanical design to allow ease of repairs and modification to particular circumstances and performance desired.

It is the object of this invention to provide a puck for use on non-ice surfaces which will approximate the physical performance characteristics of the traditional hard rubber puck used on ice surfaces while maintaining both speed and accuracy.

The present invention is a puck for use on non-ice surfaces, which is generally cylindrical in shape.

DESCRIPTION OF PREFERRED EMBODIMENT

Figure 1:
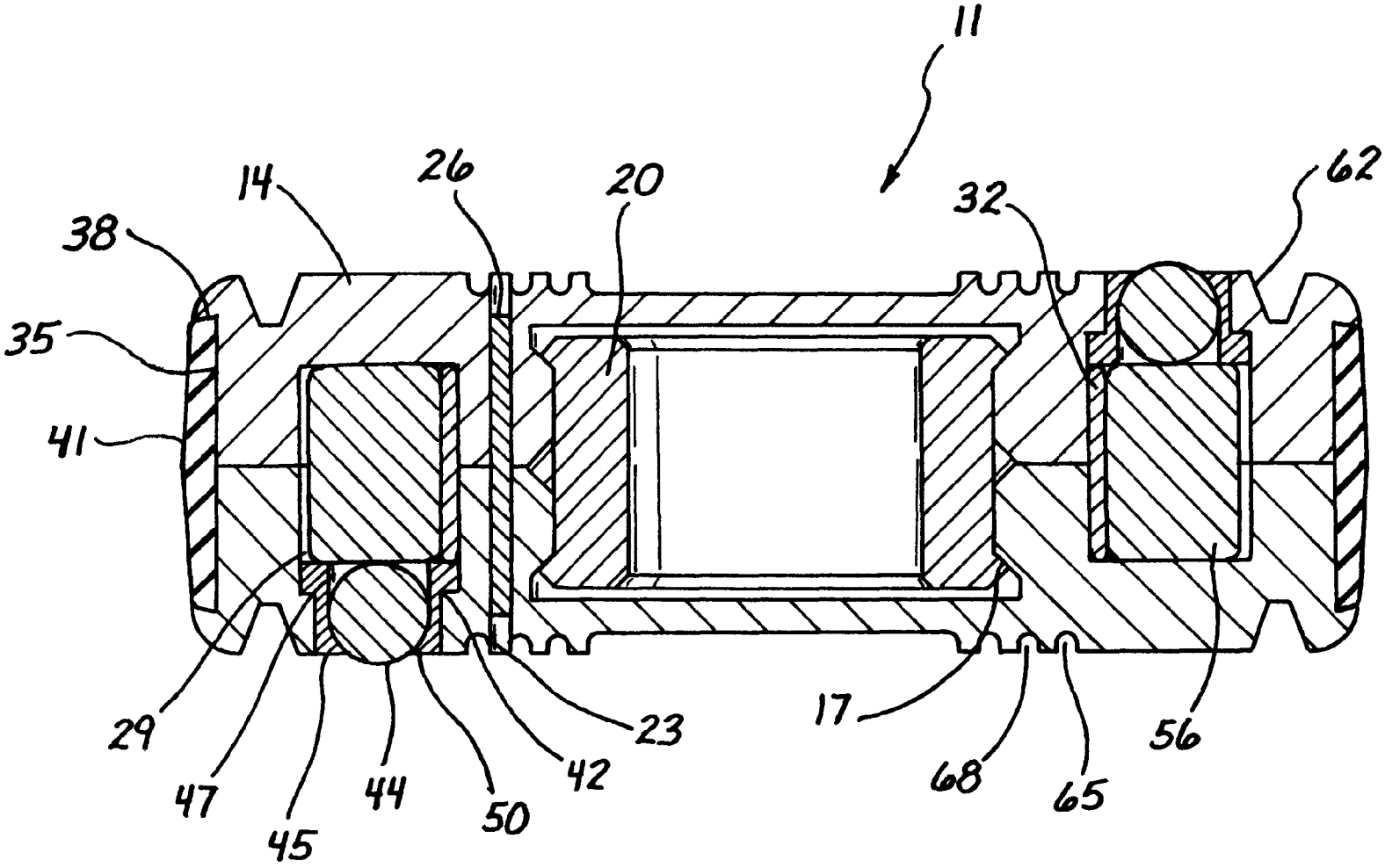

A hockey puck is usually a round disk of relatively hard plastic material, or hard rubber, designed to be propelled over a smooth floor playing area being slapped or hit with a flat bladed stick. Hockey pucks are usually approximately 7.62 cm in diameter and 2.54 cm in thickness and weigh approximately between 100 gm and 165 gm. Usually, the upper and lower surfaces are smooth and have a radius transition on the vertical periphery of the puck. Some hockey pucks designed for use in roller skate or in-line roller blade hockey games have rollers or projections on the upper and lower surfaces to minimize friction with the playing floor surface.

Additionally, many of these roller game hockey pucks have various constructions in both materials and shapes to be resilient under impact.

A few hockey pucks are designed to have some aerodynamic advantages, although, this has not become common place in practice. The hockey puck invention, hereinafter described, is an original and unique ground effect hockey puck 11 in that it features an aerodynamic design to allow it to float on a cushion of air with minimal friction with the playing surface; an original and unique roller mechanism to minimize friction during the transition period upon first being struck by the stick and the period after the hockey puck drops below the speed at which the air cushion can fully support its weight; an interchangeable internal ring;

and external bumper to allow variation of the basic puck's resilience; and a simplified mechanical design to allow ease of repair and modification to particular circumstances and performance desired.

The basic design of this preferred embodiment of a ground effect hockey puck 11 provides for a split puck body construction which allows ease of repair and modification of the hockey puck. A pair of puck body halves 14 provide the basics structure of the hockey puck. Usually, the body half 14 is a flat disk approximately half as thick as the assembled hockey puck with various grooves, recesses, and pockets formed into its surfaces. Most often, the puck body half 14 is manufactured from a hard durable plastic material with suitable strength and resilience characteristics by molding or machining processes. The material needs to be impact resistant, of such density to provide a puck weight that is acceptable, easily manufactured to close tolerances, have a good coefficient of friction, and be cost effective: such criteria apply to the materials used throughout the hockey puck's construction.

A body threaded recess 17 is provided in the center of the hockey puck, in the preferred embodiment, to allow ease of assembly and disassembly. Most often, this body threaded recess 17 does not communicate with the assembled exterior of the hockey puck, and it is threaded for an approximately 25 mm diameter by a 1.5 mm pitch thread, in the preferred embodiment.

A body assembly threaded nipple 20 is provided, in the preferred embodiment, to connect two (2) puck body halves 14 to form a hockey puck. Usually, the body assembly threaded nipple 20 is made to be slightly shorter in length than the combined recess length of two (2) assembled puck body halves 14, to fit the body threaded recess body 17, with ease and it may be hollow to lessen weight of the assembly. Most often, the body assembly threaded nipple 20 is made of a strong easily formed plastic material such as delrin, although, metals and other adequate materials may be used.

A body lock recess 23 is provided in the preferred embodiment of each puck body half 14 to allow for the installation of a body assembly lock pin 26 to prevent the hockey puck from coming apart under impact. Usually, at least one body assembly lock recess 23 is formed in each puck body half 14 by molding or machining outboard of the body threaded recess 17 which aligns with another body assembly lock recess 23 when two (2) puck body halves 14 are assembled. Most often, at least one body assembly lock pin 26 is fitted in such aligned body assembly lock recess 23 in the mated puck body halves 14 to lock the hockey puck body together. The body assembly lock pin 26 is usually a tight enough fit in the body assembly lock recess 23 not to be freed by impacts during game play but easily pressed or pushed out by a hand tool like a cylindrical drift for ease of assembly and disassembly. Usually in the preferred embodiment, a Spirol brand coiled pin is used for the body assembly lock pin 26 which is slightly shorter in length than the total length of the aligned body assembly lock recess 23, so as not to protrude from the assembled hockey puck's surfaces: like a part number 3-20-XL-D-P pin available from Spirol International Corporation, C.E.M. West, Inc., PO Box 898, Westminster, Calif. 92683. The resilient construction of this type of pin grips the walls of the body assembly lock recess 23 and allows for easy installation and removal while not loosening due to impacts to the hockey puck. Other fastening techniques may be applied to the hockey puck including but not limited to bayonet type fastening lugs and recess devices, through bolted fastening, and snap-together fastening if so desired.

A body alignment ring recess 29 is provided in the preferred embodiment's mating face of the puck body half 14 to allow for alignment between the two mating puck body halves 14. Usually, the body alignment recess 29 is outboard of the body threaded recess 17, and it is near the perimeter of the hockey puck. Most often, this body alignment ring recess 29 does not communicate with the assembled exterior of the hockey puck and provides for mounting a locating device between the puck body halves 14.

A body alignment and weight adjustment ring 32 is usually mounted, in the preferred embodiment, within the body alignment ring recess 29 to provide accurate location between the puck body halves 14, and positive location of the roller retainer insert 45. The body alignment and weight adjustment ring 32 may be used to allow for ease of adjustment of the hockey puck's weight to the desired criteria by varying its dimensions or material of construction. In the preferred embodiment, the body alignment and weight adjustment ring 32 contacts the roller retainer insert 45 in each puck body half 14, to provide vertical restrain of the roller retainer insert 45 locking them in place. Most often, the body alignment and weight adjustment ring 32 locates on the inner wall of the body alignment ring recess 29. Usually, the body alignment and weight ring 32 is constructed in the form of a section of tubing. Usually, this tubing is made of steel, although, other suitable materials such as aluminum, other metals, and rigid plastic would be satisfactory. Therefore in this preferred embodiment, the body alignment and weight adjustment ring 32 may be conveniently varied in wall thickness to provide the weight adjustment feature of the hockey puck while enabling its easy removal and replacement from the body alignment ring recess 29.

The hockey puck's flight characteristics may be varied, in the preferred embodiment, by changing the body alignment and weight adjustment ring's 32 dimensions, the ring's location and fit in the recess, the ring's material specifications, the position in relation to the pucks periphery of the body alignment ring recess 29, and the recess's form and dimensions.

A puck body retaining pocket 42 is provided, in the preferred embodiment, to provide lateral and vertical restraint of of the roller retainer insert 45. Most often, the puck body retaining pocket 42 provides for the installation of a roller retainer insert 45.

A bumper body recess 35 is provided, in the preferred embodiment, on outer radial perimeter of each puck body half 14 for the installation of an external bumper device around the center of an assembled hockey puck. Usually, the body bumper recess 35 axially ends before the puck body half's edge transition from the vertical radial dimension to its flat horizontal dimension to provide a body bumper holding edge 38 for the bumper. In the preferred embodiment, the body bumper holding edge 38 is slightly undercut to help prevent the bumper device from being lifted from the puck when impacted, however, in other embodiments it may be straight or other satisfactory form. The bottom of the body bumper recess 35, in the preferred embodiment, is usually straight but it may be a segment of a circle, form a point, by grooved, or a combination of such features in other embodiments.

A perimeter resilient bumper 41 is provided, in the preferred embodiment, for absorbing impacts from both the hockey stick, absorbing impacts from objects the hockey puck may strike, adjusting the resiliency of the puck, and limiting the puck's on edge rolling distance. Most often, the perimeter resilient bumper 41 is manufactured from a resilient impact absorbing material such as rubber or polyurathane and can be varied in accordance with different player requirements. The outer periphery of the perimeter resilient bumper 41 is a segment of a circle in the preferred embodiment, although, flat surfaces; triangular shaped surfaces, and grooved surfaces may be used. To prevent edge rolling of the hockey puck, the place consisting of the puck's extreme radial periphery limit, along with the puck would usually edge roll if it were symmetrical with the cylindrical axis of the puck, is to be slightly canted across the cylindrical axis: this can be likened to the canted plane created by slicing a salami roll at a slight angle. In the preferred embodiment, the perimeter resilient bumper's 41 radial periphery plane is canted approximately 2 degrees from one side of the puck to the other. This axial variance of the potential edge rolling plane of the hockey puck, which forms the place of roll, unbalance the puck's rolling stability causing the puck to more quickly fall into the preferred flat sliding attitude without adversely effecting the interface between the puck's radial perimeter impact surface and either the stick or impact surfaces around the playing floor.

A roller retainer insert 45 is provided, in the preferred embodiment, along with a roller spacer ring 56 to provide a cavity for each roller 44, to establish the preferred ride height or gap to best initiate ground effect air cushion condition of flight. Usually, this gap or clearance of approximately 0.4 mm and 0.6 mm between the body of the puck and the playing surface has allowed best functioning. Most often, the roller retainer insert 45 is made of a hard and wear resistant material such as hardened steel which can be machined or other materials having a good coefficient of friction such as such as low friction aluminum alloys.

A roller 44 is provided, in the preferred embodiment, to provide the primary contact of the hockey puck with the playing floor surface, decreasing the friction between the hockey puck and the playing floor at low speeds, and to establish the preferred ride height or gap to best initiate ground effect air cushion condition of flight. Most often, the roller 44 provided is made of a hard and wear resistant material such as hardened bearing steel or ceramic material such as silicon nitride which is lapped to form a smooth rolling surface. In the preferred embodiment, there are five (5) roller 44 in each puck body half, and the rollers 44 used are most often bearing steel balls approximately 6.35 mm in diameter.

A roller retainer pocket 47 functions, in the preferred embodiment, to provide lateral restraint of the lateral thrust loads produced by the roller 44 or rollers due to movement of the puck across the floor surface. The inside walls of the roller retainer pockets 47 provide the clearance which allows the roller 44 to freely rotate. Usually, this clearance has allowed best functioning of the roller at a total diametrical gap between approximately 0.01 mm and 0.04 mm for a roller of approximately 6.35 mm diameter; this is usually a sufficient range to allow for manufacturing tolerances.

A roller retainer lip 50 is provided, in the preferred embodiment, to establish the basics or transitional, to flight, vertical clearance of the hockey puck in relation to the playing floor. In the preferred embodiment, the roller retainer lip 50 is formed as part of the roller retainer insert 45 by molding or machining practice. The transitional vertical clearance between the hockey puck and the playing floor provided the initial flight height best suited for establishing the aerodynamic condition which allows the hockey puck to fly in ground effect over the playing floor surface.

The roller spacer ring 56 is contained, in the preferred embodiment, in a roller spacer ring recess 29 on the inner surface of the puck body half 14 to adjust the vertical running clearance of the roller 44 in the roller retainer pocket 47. The roller spacer ring 56 provides, in the preferred embodiment, the vertical bearing surface for the roller 44 and transfers the vertical loading from the roller 44 to the puck body half 14. Most often, the roller spacer ring 56 is a loose sliding fit in the roller retainer pocket 47 to provide reliable functioning of its force transferring function.

Usually, the roller spacer ring 56 bridges the inner opening of the roller retainer pocket 47 or pockets to transfer the vertical loading the hockey puck body. Most often, the vertical clearance of the roller 44 in the roller retainer pocket 47 is adjusted with the vertical thickness of the roller spacer ring 56. In the preferred embodiment, this clearance best functions between approximately 0.02 mm and 0.04 mm for a roller 44 of approximately 6.35 mm diameter, which sufficient range to allow for manufacturing tolerances. Usually, the roller spacer ring 56 is made of a relatively hard plastic material having a good coefficient of friction or other anti-friction plastic.

The roller mechanism is mainly used to minimize friction during the transition period upon first being struck by the stick until the ground effect hockey puck 11 is in ground effect, riding mostly on a cushion of ar with perhaps light occasional contact with the playing floor, and the period after the ground effect hockey puck 11 drops below the speed at which the air cushion can fully support its weight.

The hockey puck invention herein described is an original and unique ground effect hockey puck 11 in that it features an aerodynamic design to allow it to float on a cushion of air with minimal friction with the playing surface which enhances its ability to maintain its original velocity. Usually, this is accomplished by generating an air cushion, due to the motion of the puck, and maintaining it as long in time as possible. This air cushion is created by the motion of the flat plate surface of the ground effect hockey puck 11 in relation to the flat playing floor. There is a pressure gradient established by the velocity of the ground effect hockey puck 11 which varies either by decreasing from the leading edge of the puck to its trailing edge, in relation to its lineal movement, or by decreasing from the perimeter of the puck to its center, in relation to its rotational movement. These separate causes of pressure gradient may be combined when the hockey puck is spinning and sliding in relation to the playing floor surface.

Due to the pre-established gap between the ground effect hockey puck 11 and the floor, by the rollers 44, this pressure gradient not only exists across both the upper surface of the puck body but across the lower surface of the puck in the gap. Additionally, the air flow over both the upper and lower moving surfaces of the ground effect hockey puck 11 have boundary layers of air attached during this motion, along with the boundary layer of air associated with the stationary floor, if it exists. In order to establish an air cushion or air bearing to support the ground effect hockey puck 11 the boundary layer of air flow between the lower surface of the ground effect hockey puck and the playing floor needs to have a turbulent flow condition established and the pressure gradient from the leading to trailing edge or perimeter to the center of the puck reduced. Both desirable phenomenon, consisting of the turbulent flow and the balancing of the pressure across the lower surface of the puck, increasing the pressure under the ground effect hockey puck 11 in relation to the relatively free stream air flow over the top of the puck creating a lifting or cushion action of the puck in relation to the floor surface. Therefore, a turbulator and a pressure balancing mechanism are provided by the unique and original invention of the disk surfaces presented by the ground effect hockey puck 11.

The turbulator usually consists of a turbulator groove 62 near the outer perimeter of the flat disk surface of the ground effect hockey puck 11 close to the edge. At least one turbulator groove is used. This turbulator groove 62 is just inboard of the edge transition radius between the horizontal flat plate surfaces of the puck and the vertical cylindrical surface. In the preferred embodiment, the turbulator groove 62 is approximately 3.8 mm wide at the surface of the puck tapering to 1.0 mm wide at its termination 5.7 mm axially deep with its centerline approximately 4.45 mm from the perimeter edge of the puck and the edge of the puck has an approximate 2.3 mm radius form to it. Usually, the edges of the turbulator groove 62 are relatively sharp, however, a slight edge break such as a radius or chamfer can be used. Additionally, the turbulator groove 62 can be segmented to form closely adjoining slots if so desired and may have straight sides or even form a slight undercut recess. If a slotted turbulator groove is used, its segments may be at an angle up to ninety (90) degrees greater or lessor than in a plane of in tangent with the outer circumference of the puck. The turbulator groove 62 when formed as a continuous groove to the playing surface, and the turbulator groove 62 when formed as a neat radius slot functions best in conditions of high puck angular velocity. Therefore, the turbulator groove 62 works best when it is ninety (90) degrees in relation to the vector sum of the puck's translational and rotational velocity component; the turbulator groove 62 can have a wide range of puck operating conditions covered by forming it as a continuous groove which has radial deviations around the perimeter of the puck. These radial deviations can take the form of a wavy or zigzag pattern in the turbulator groove's 62 course around the puck. The turbulator groove 62, when formed as an uninterrupted groove, functions as a pressure balancing device for the puck; by helping balance the pressure gradient across the puck from the leading edge to the trailing edge.

An additional turbulator groove or grooves may be provided inboard of the main turbulator groove to improve the turbulent air flow condition although these turbulator grooves usually do not need to be of the same dimension as the first turbulator groove 62. In the preferred embodiment, there are a pair of secondary turbulator grooves 65 provided just inboard of the first with dimensions of approximately 1.25 mm wide at the surface of the puck tapering to 1.0 mm at its termination 1.25 mm deep with each groove's centerline spaced approximately 2.0 mm from the other and the outer one spaced approximately 4.0 mm from the centerline of the larger turbulator groove 62. The secondary turbulator groove 65 can be segmented to form closely adjoining slots if so desired and may have straight sides or even form a slight undercut recess. If a slotted secondary turbulator groove 65 is used its segments may be angled up ninety (90) degrees greater or lesser than in a plane of the tangent with the outer circumference of the puck. The secondary turbulator groove 65 when formed as a continuous groove in the shape such as a circle functions best in conditions of high puck velocity in relation to the playing surface, and the secondary turbulator groove 65 when formed as a near radial slot functions best in conditions of high puck angular velocity. Therefore, the secondary turbulator groove 65 works best when it is ninety (90) degrees in relation to the vector sum of the puck's translational and rotational velocity component; the secondary turbulator groove 65 can have a wide range of puck operating conditions covered by forming it as a continuous groove which has radial deviations around the perimeter of the puck. These radial deviations can take the form of a wavy or zigzag pattern in the secondary turbulator groove's 65 course around the puck. Most often, this secondary turbulator groove 65 functions to further develop and maintain the turbulent flow condition between the puck and the floor. The secondary turbulator groove 65, when formed as an uninterrupted groove, functions as a pressure balance device for the puck; by helping balance the pressure gradient across the puck from the leading edge to the trailing edge.

The ground effect hockey puck 11 usually has at least one pressure balance groove 68 to help balance the pressure gradient across the puck from the leading edge to the trailing edge located inboard of the turbulator groove 62. Usually, this pressure balance groove 68 provides a path to allow air flow from a high pressure area to a low pressure area to generate equal pressure across the relatively flat disk surface of the puck during its movement through the air allowing better working of the ground effect cushion and a more even attitude, of the puck in relation to the floor surface. In the preferred embodiment, there are several pressure balancing grooves 68 provided just inboard of the turbulator groove 62 with dimensions of approximately 1.25 mm wide at the surface of the puck tapering to 1.0 mm wide at its termination 1.25 mm deep with each groove's centerline spaced approximately 5.0 mm from each other and the outer one spaced approximately 5.0 mm from the centerline fo the most inboard turbulator groove. The pressure balance groove 68 should be of such dimension as to usually allow free and unobstructed flow of air around the hockey puck when the puck is moving and this applies to the other grooves is used in this function.

Have thus described the invention, what is claimed is:

1. A ground effect hockey puck for use on a playing surface comprising:

A puck having opposing horizontal flat plate surfaces, a vertical cylindrical surface and an edge between each of said flat plate surfaces and said cylindrical surface;

at least a first groove on each of said horizontal flat plate surfaces just inboard of said edge;

a plurality of rollers inboard of each of said first grooves, said rollers adapted to maintain a ride height between one of said flat plate surfaces and the playing surface;

at least a second groove, inboard of said rollers, on each of said horizontal flat plate surfaces; and at least a third groove, wherein said at least a third groove is continuous, inboard of said rollers, on each of said horizontal flat plate surfaces.

2. The hockey puck of claim 1 wherein said at least a first groove is segmented to form closely adjoining slots.

3. The hockey puck of claim 1 wherein said at least a second groove is segmented to form closely adjoining slots.

4. The hockey puck of claim 1 further comprising a plurality of continuous grooves inboard of said rollers, on each of said horizontal flat plate surfaces.

* * * * *